United States Patent [19]

Korkut

[11] 4,065,101

[45] Dec. 27, 1977

[54] TORSION SPOOL

[76] Inventor: Mehmet D. Korkut, 3848 Veteran Blvd., Metairie, La. 70002

[21] Appl. No.: 730,502

[22] Filed: Oct. 7, 1976

[51] Int. Cl.[2] ..... B66D 1/26

[52] U.S. Cl. ..... 254/184; 226/118; 242/47.1

[58] Field of Search ..... 254/183, 184, 175.7, 254/175.5; 114/264, 265, 253, 254, 244, 293, 230; 242/47.1, 47.01, 47.08, 47.09, 47.11, 47.12; 226/118

[56] References Cited

U.S. PATENT DOCUMENTS

| | | | |
|---|---|---|---|
| 1,661,275 | 3/1928 | Stensland | 254/175.7 |
| 2,317,747 | 4/1943 | Ewing | 242/47.1 |

FOREIGN PATENT DOCUMENTS

| | | | |
|---|---|---|---|
| 604,102 | 8/1960 | Canada | 242/47.1 |
| 67,786 | 6/1940 | Czechoslovakia | 242/47.1 |

*Primary Examiner*—Robert J. Spar

*Assistant Examiner*—Donald W. Underwood

*Attorney, Agent, or Firm*—James B. Lake, Jr.

[57] ABSTRACT

A stationary gear is keyed to a center shaft which is supported longitudinally in a frame. Gears identical with the stationary gear mesh therewith as equally spaced satellites therearound. The satellite gears are fixed on respective satellite shafts, which are mounted for rotation in and between a pair of longitudinally spaced plates that are mounted for rotation on the center shaft. Cylinders, on which are defined helical grooves for engaging a line, are keyed to the respective satellite shafts for rotation therewith. The helical grooves of the respective cylinders have a transverse pitch angle per revolutions of the respective cylinders and plates that is a function of the distance between centers of adjacent cylinders and the center angle subtended thereby, the common diameter of center and cylinder gears, and the diameter of the engaging line, that add up closest to "1H" and straight tracking to provide a tracking error of less than 0.1° instead of a usual tracking error of 3°.

9 Claims, 5 Drawing Figures

TORSION SPOOL

BACKGROUND OF THE INVENTION

The invention relates generally to winches and more particularly to traction spools for reeling in and out lines with little or no chaffing.

The prior art falls into two classes: one class having a rotatable drum that is axially movable as per U.S. patents to E. E. Martin U.S. Pat. No. 2,478,494, and to J. E. Minty U.S. Pat. No. 2,868,504; and a second class with additional cable retainers and/or tubes as in U.S. patents to D. M. Nelson U.S. Pat. No. 3,353,793 and to L. Gallagher U.S. Pat. No. 3,410,526.

SUMMARY OF THE INVENTION

An object of the invention is to provide a powered or unpowered torsion spool having a drum comprising a plurality of helically grooved satellite cylinders mounted for rotation around their respective axes, and the drum being rotatable about its axis.

Another object of the invention is to provide circumferentially and radially equal spacing from and around a center stationary gear of satellite gears respectively fixed to said satellite cylinders for each satellite gear and cylinder to make one revolution around their respective axes as the drum completes a revolution for each one.

A further object of the invention is to provide a continuous helical groove on each of said cylinders that in combination spools a line around the drum without chafing.

DETAILED DESCRIPTION OF THE INVENTION

Figure 1:
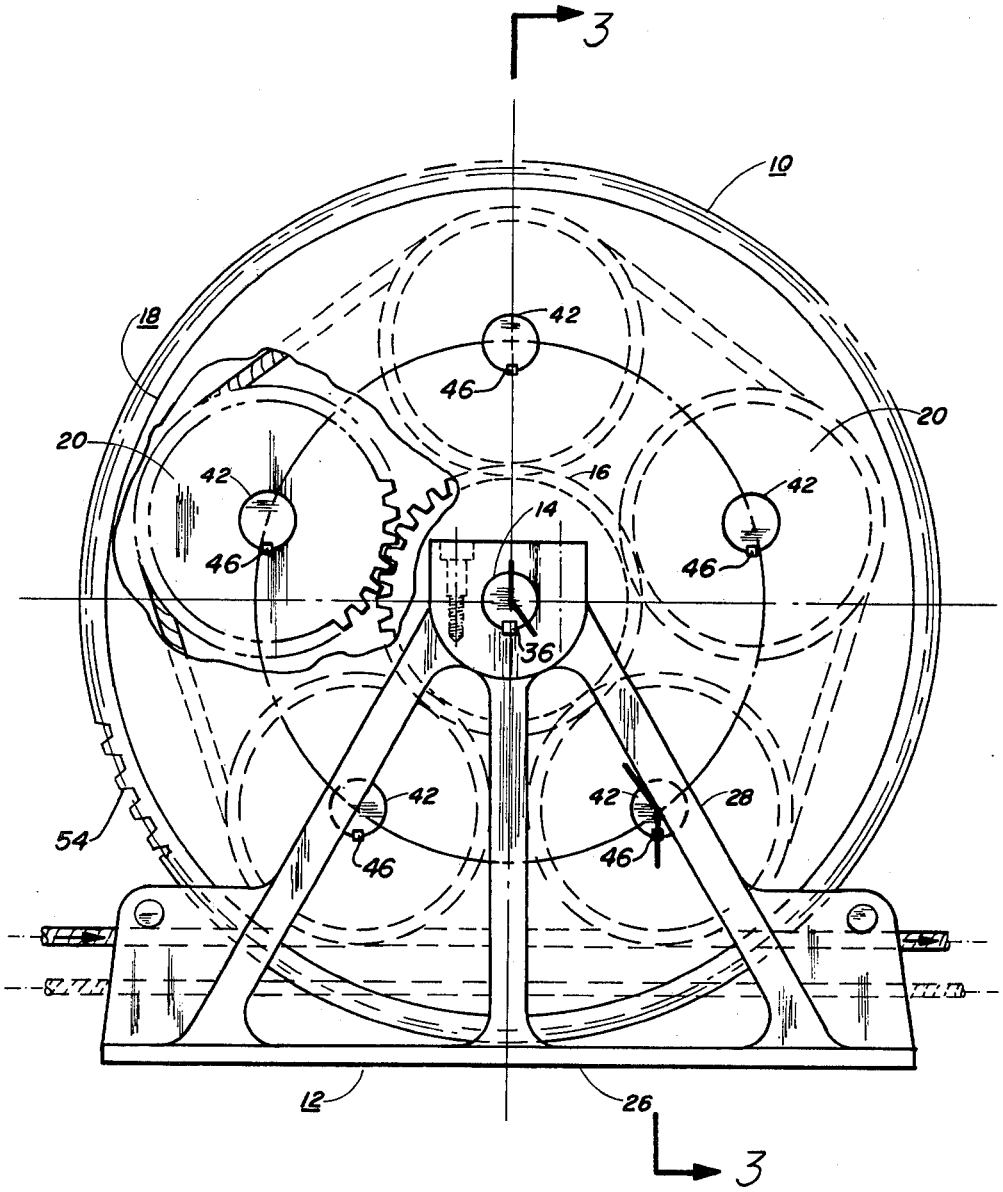
FIG. 1 is a side view of the invention.
Figure 2:
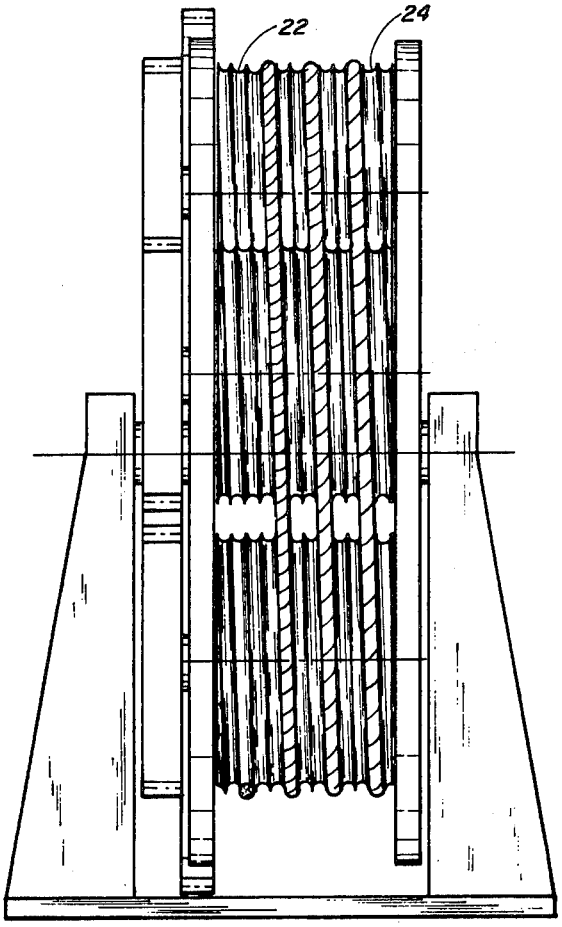
FIG. 2 is an end view of the invention.

The invention 10 comprises a stand 12 for supporting a stationary shaft 14 on which is fixed a center gear 16. A composite drum 18 is mounted for rotation on shaft 14 and to engage center gear 16 with a plurality of satellite gears 20. Helical grooves 22 are defined by cylinders 24, comprising with gears 20 composite drum 18, to conform in size to a desired diameter of a spooling line, and in pitch to a function of the length of a tangent between adjacent cylinders 24, the radial and circumferential spacing and the diameter of gears 20 and cylinders 24 comprising drum 18, and said spooling line diameter plus a pitch factor that brings the grooves 22 of each cyliner 24 into congruency with those of the preceeding and following cylinders 24 with the spooling line extending linearly there between and around in said grooves. See FIGS. 1–3.

Stand 12 comprises a base 26 and two horizontally spaced apart uprights 28 and 30 that define in their respective upper ends 32 and 34 holes adapted to receive stationary shaft 14 and support it by its respective ends. Center gear 16 is mounted adjacent shaft 14 and end 32, inboard of upright 28, and the gear, shaft end and upright are keyed together by a key 36.

Composite drum 18 comprises two circular end plates 38 and 40 that are spaced parallely apart and mounted for rotation on stationary shaft 14 between stand 12 uprights 28 and 30, and inboard of center gear 16. Shafts 42 are mounted in bearings 44 fixed in plates 38 and 40, and are spaced equally around the plates for mounting satellite gears 20 for intermeshing with center gear 16. Satellite gears 20 are respectively keyed with keys 46 to shafts 42 for rotation therewith as plates 38 and 40 are rotated around stationary shaft 14. A driving gear (not shown) is adapted to mesh with gear teeth 54 of plate 38, for driving the composite drum in rotation by a motor (not shown).

Figure 3:
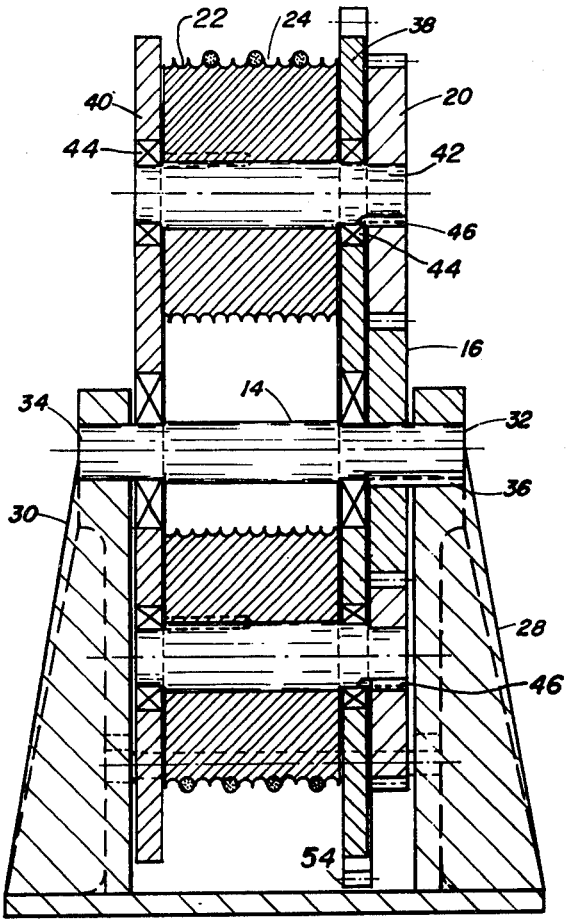
FIG. 3 is a sectional view taken along section lines 3—3 of FIG. 1.
Figure 4:
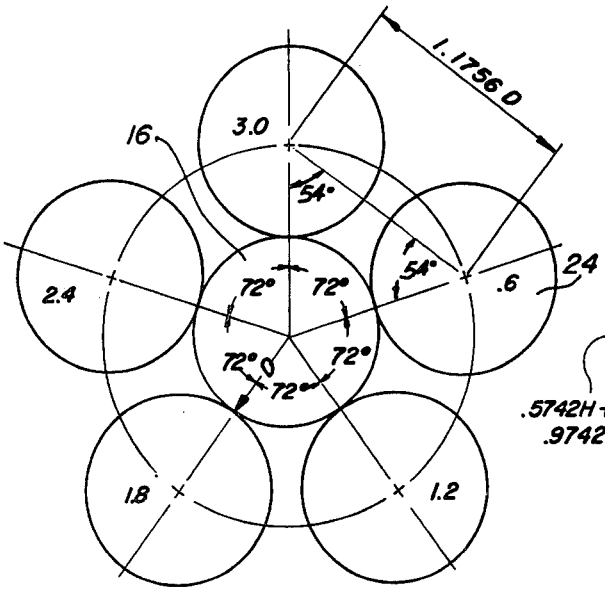
FIG. 4 is a diagrammatic sketch indicating numerical relations of elements of the invention.
Figure 5:
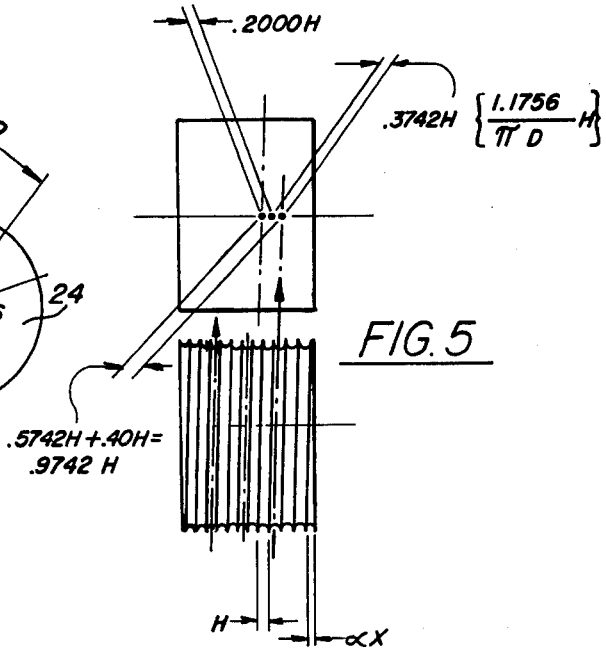
FIG. 5 is similar to FIG. 4 but normal thereto.

Referring to FIGS. 3–5, helical grooves 22 defined on the respective cylinders are in pitch and position a function of the diameters of the gears and spooling line and the distances between centers of the satellite gears and cylinders. The maximum number of satellite gears that can be arranged around a center gear, all of the same diameter, is five for all of the gears to mesh with the center gear without interfering with each other. Thus the angle between satellites is 72° and the distance between their centers is 1.1756 "D" where "D" is the common diameter of the gears. This distance is obtained by dividing the sine of 72° degrees by the sine of 54 ° obtained from the geometry of FIG. 4. Now if "H" represents both the width of a groove and the pitch of the groove helix then the transverse path of the groove, by the rotation of drum 18, 72° around stationary shaft 14 will equal 1.1756 "D" divided by "pi" "D" and multiplied by "H", that is 0.3742 "H". The cylinders and gears are also being rotated around their respective shafts 42 to advance 72° or 1/5th, that is 0.2, of a revolution for an additional 0.2"H" added to the transverse path of the groove from cylinder to cylinder. Now if the linearity of the spooling line in the grooves and over the cylinders and the width and helix of grooves equal to 1"H", the transverse movement of the grooves must come to as close to "1" as possible. By rotating the cylinders in place for an additional 0.4 "H" transverse displacement of the grooves and adding this to the other displacements 0.3742 "H", and 0.2 "H" for a total of 0.9742 "H" is obtained which is only 0.0258 less than 1"H" or straight tracking, and which is a smaller error than the addition of 0.5"H" would produce. For a torsion spool in which a spooling line of diameter "*d*" is used, and the groove width and helix of 1.5 "*d*", and a cylinder diameter "D" of 20 "*d*", then the deviation in straight tracking is the function of the natural tangent of delta "*x*" (see FIG. 5), that is 0.0258"H" divided by 1.1756 "D" which is 0.0258(1.5"*d*") divided by 1.1756(20"*d*") or 0.001646 radian or 0.094° , that is less than 0.1° . The error in straight tracking for convention torsion spools is of the order of 3° , that is 30 times the 0.1° of the invention which therefor produces 30 times less chafing of the spooled line.

It should be noted that if the 0.6 "H" is added to the transverse movement of the groove due to rotation around the stationary shaft, 0.3742"H", the displacement for the five cylinders will be 3"H" and thus the spooling line will track on every third groove. By using all the grooves, three lines can be fed feed into the traction spool, side by side, and be spooled out similarly. The inputs and outputs are constant so that one large load can be supported in any desired attitude by three lines regardless of the rise and fall of the supporting structure such as a water born vessel.

What is claimed is:

1. An improved torsion spool for reeling spooling line in and out comprising:

a. a stand secured to supporting structure and extending substantially thereabove;

b. a stationary shaft supported by its ends on said stand;

c. a center gear fixed on said stationary shaft and adjacent and end thereof;

d. a composite drum having circular end plates center mounted on and around said stationary shaft for rotation therearound, said end plates being spaced apart by a plurality of transverse shafts mounted for rotation therein and therebetween without interference with each other, said transverse shafts being mounted intermediate the center and the perimeter of said circular end plates;

e. a plurality of satellite gears, similar to and meshing with said center gear, keyed respectively to said transverse shafts for rotation therewith as said drum end plates rotate around said stationary shaft;

f. a plurality of satellite cylinders fixed to said transverse shafts for rotation therewith, said cylinders having circumferential surfaces defining respectively similar helical grooves and adjustable with respective shafts and satellite gears to position for said grooves of adjacent cylinders to be in helical alignment; and g. means to rotate said end plates.

2. An improved torsion spool as described in claim 1 wherein said plurality of transverse shafts, gears mounted thereon, and cylinders is five.

3. An improved torsion spool as described in claim 1 wherein said helical grooves have a pitch equal to the width of a groove.

4. An improved torsion spool as described in claim 1 wherein said width of a groove is 1.5 the diameter of said spooling line diameter.

5. An improved torsion spool as described in claim 1 wherein said satellite gears and cylinders are 20 times the diameter of said spooling line.

6. An improved torsion spool as described in claim 1 wherein said satellite cylinders are rotated in place to transversely advance said helical grooves an additional 0.6 of said groove width advance due to drum rotation, for engaging said spooling line.

7. An advance of helical grooves as described in claim 6 wherein said spooling line engages in every third groove.

8. The engagement of a spooling line in every third groove as describe in claim 7 wherein the spooling lines are simultaneously reeled in and out of said helicla grooves.

9. An improved torsion spool as described in claim 1 wherein one of said end plates has gear teeth defined around its circumference and said means for rotating said end plates comprising a complementary driving gear of a motor for engaging said gear teeth and thus rotating said drum.

* * * * *